United States Patent [19]

Fleissner

[11] Patent Number: 4,586,268

[45] Date of Patent: May 6, 1986

[54] HEAT TREATMENT TUNNEL

[75] Inventor: Heinz Fleissner, Riehen, Switzerland

[73] Assignee: Vepa Aktiengesellschaft, Basel, Switzerland

[21] Appl. No.: 468,299

[22] Filed: Feb. 22, 1983

[30] Foreign Application Priority Data

| | | | |
|---|---|---|---|
| Feb. 19, 1982 | [DE] | Fed. Rep. of Germany | 3205962 |
| Feb. 20, 1982 | [DE] | Fed. Rep. of Germany | 3206158 |
| May 4, 1982 | [DE] | Fed. Rep. of Germany | 3216558 |
| Jun. 23, 1982 | [DE] | Fed. Rep. of Germany | 3223401 |

[51] Int. Cl.[4] ..... F26B 13/10

[52] U.S. Cl. ..... 34/68; 34/41; 34/155; 34/242

[58] Field of Search ..... 34/41, 155, 82, 68, 34/242; 68/5 C, 5 D, 5 E

[56] References Cited

U.S. PATENT DOCUMENTS

| | | | |
|---|---|---|---|
| 2,629,162 | 2/1953 | Peck | 34/41 |
| 3,793,741 | 2/1974 | Smith, Jr. | 34/68 |
| 3,972,127 | 8/1976 | Hoshi et al. | 34/242 |
| 4,202,112 | 5/1980 | Eltz et al. | 34/41 |
| 4,365,423 | 12/1982 | Arter et al. | 34/155 |
| 4,435,909 | 3/1984 | Williamson, Jr. | 34/82 |

*Primary Examiner*—Larry I. Schwartz

*Attorney, Agent, or Firm*—Antonelli, Terry & Wands

[57] ABSTRACT

A heat treatment tunnel for the treatment of fibers, threads slit film or the like fibrillary material used in the textile field is arranged to extend horizontally. The material to be heat treated is transported along a travel path, in endless length form, through the horizontally arranged tunnel. This tunnel includes a heat-insulated housing having an inlet slot for entry of the material and an outlet slot for withdrawal of the material from the housing; a fan chamber; a fan arranged within the chamber for effecting circulation of a gaseous treatment medium within the housing; a heater disposed downstream of the fan for heating the treatment medium; a fan intake connecting pipe positioned either above or below the traveling material to draw the gaseous treatment medium away from the travel path and fan exhaust openings positioned either below or above the traveling material; i.e., opposite to the location of the fan intake connecting pipe, to direct the gaseous treatment medium toward the travel path. The heater extends in parallel with and in close juxtaposition to the travel path over the entire length and width of the travel path. A screen wall is arranged above and below the heater for regulating the flow of treatment medium whereby heat is retained around the heater to provide a source of uniform heat across the width and length of the traveling material. Also, a seal or closure is provided for sealing marginal zones of the heater so that the zones are gas-impermeable; i.e., no gas can pass into or out through the zones.

28 Claims, 14 Drawing Figures

HEAT TREATMENT TUNNEL

This invention relates to a heat treatment device, especially a tunnel (e.g., oven, chamber or the like tube-shaped structure) for the treatment of fibrillary material; e.g., fibers, threads, slit film, or the like, used in the textile field, wherein the textile material is transported in endless length form through the horizontally installed tunnel; this tunnel includes a heat-insulated housing provided with an inlet and an outlet for the traveling material wherein, in a fan chamber, a fan is arranged and, in the circulation of the treatment medium downstream thereof, a heater is disposed.

A plurality of constructions of heat treatment devices for the treatment of various materials has been known. First of all, worth mentioning in this connection is the belt dryer, wherein the treatment goods lie on an endless belt of this dryer, held under horizontal tension, with the treatment gaseous medium; e.g., heated air, flowing through these goods. For this purpose, the space below the endless belt is associated with a fan supported along the treatment chamber in a fan chamber; heating units, likewise disposed in the fan chamber, are associated at the top with this fan. One example of such a dryer is shown in DOS (German Unexamined Laid-Open Application) No. 2,341,590.

In another construction, a woven length of material is supplied with air as the treatment medium from above as well as from below. The treatment medium here can either be conducted through the length of material and exhausted from the other side of the length of material, or it can also impinge on the length of material, so that upper and lower air circulations are created. The fan required to produce the air flow can either be associated only with one side of the length of material or simultaneously with both sides. Here again, a heater is customarily paired with the fan; such heater is fashioned, for example, according to DOS No. 2,302,107, as a perpendicular partition between the fan chamber and the treatment chamber through which the woven material travels.

In the construction according to DOS No. 1,951,625, the material disposed on the endless belt is subjected, by means of a fan arranged underneath the endless belt, to a suction draft from the top toward the bottom and also is subjected to a throughflow from the bottom toward the top. Besides this alternating throughflow to which the length of material is subjected, so-called float dryers are, likewise, known wherein the woven material to be treated is generally held by laterally horizontally guided chains and is subjected to a throughflow merely from the bottom toward the top. Here, too, the heating units are directly associated with the fan in order to be able to make optimum use of the flow energy, increased in the direct vicinity of the fan, when the air flows through the heating unit.

The invention is based on the object of developing a device, by means of which the treatment air or the treatment heat can be supplied absolutely uniformly over the working width of the length of textile material, which material can comprise slit film, especially one formed solely of synthetic fiber strands or, better, threads or the like fibrillary material used, for example, in the textile field, arranged individually side-by-side. Maximum requirements must be met regarding uniformity, since temperature differences of larger than 1° C. over the working area of the textile material must not be exceeded. Uniformity is not only demanded of the temperature, but also of any possibly existing flow velocity between the central and marginal zones of the length of material; e.g., a plurality of parallel strands or threads.

Starting with the device of the type described heretofore, the invention provides, for solving the thus-posed problem, a heat treatment tunnel having several features to be considered in combination, for example:

(a) a fan intake means; e.g., pipe, duct or the like, should be associated solely with the topside of the thread path; whereas (b) fan exhaust openings are associated solely with the bottom side of the thread path; furthermore, (c) one or more heating units should extend in parallel with and directly underneath the thread path over the entire length and width of material treating section of the tunnel;

(d) a screen wall as a retaining cover should be arranged below and/or above the heating units; and (e) the marginal zones of the heating units should be sealed to be air-impermeable.

The essential advantage of this provision is that the heating unit or units can serve for rendering the flow uniform over the working width of the textile material such as a plurality of strands, threads or continuous filaments of synthetic polymer. An entirely uniform, upwardly oriented flow of uniformly heated air is ensured by the arrangement of the heating units, normally constructed as ribbed pipes through which flows a heating medium (e.g., heated liquid, vapor, or mixture of both), the adjacent ribs of which, in close mutual adjacency, should even contact one another and extend in parallel to the route of the treated material or, in this case, of the threads; the additionally provided retaining screen wall or cover is a contributing factor in this connection. No effect is exerted any longer by air flow lines on the air distribution in the space below the length of treated material, which otherwise would have an effect due to the air flow from the fan to the treatment chamber. Another important feature is also the special insulation of the heating unit in the zone of the outer wall of the device in this defined arrangement of the heating unit (or units). The heating unit is customarily considerably warmer than the traversing air. Furthermore, via heat conductance within the material, heat is more rapidly removed toward the external areas in the direction of the prevailing temperature gradient. This heat conductance must be absolutely prevented; this is made possible by insulation with the aid of the insulating material "Marinite," for example.

The fan must cover an area of the length of the treated material which is larger than the fan intake connecting pipe. It is possible to arrange the fan above the length of material with the intake connecting pipe being oriented in parallel to the length of treated material. However, this entails additional deflection zones for the air flow after the fan, which is disadvantageous for the accelerated air. In the device of this invention, the fan is mounted, as is conventional, at the side face of the treatment chamber in a separate fan chamber. The fan is suitably fashioned as a radial-flow fan and a plurality of fans are arranged along the length of the treated material traveling through the tunnel. In order to make the localized intake zone of each fan effective uniformly over the horizontally aligned area of the length of the material; e.g., the threads, a screen cover is arranged, on the one hand, above the thread route over the width and length of the treatment section of the tunnel, and, on the other hand, a fan intake chamber is narrowed above the thread route on both sides conically toward the center of the width of the thread route. Thus, the upwardly oriented flow along both longitudinal sides of the width of the thread route is uniform, independent of the arrangement of the fan only on one side. In order to complete the arrangement, the provision is suitably made to cause the fan chamber—as seen in cross section—to taper pointedly in triangular form in the upward direction; a fan intake connecting pipe adjoins this chamber via an intake duct in the upper portion of the fan intake chamber. It is, furthermore, advantageous for a uniform air distribution to connect the intake duct—conically flaring;13 from the fan intake connecting pipe to the fan intake chamber.

It is necessary for the continuous treatment of a length of textile material in a heat treatment tunnel to constantly exhaust consumed air and to take in fresh air. Customarily, the exhaust connecting pipe is disposed in the zone of the inlet for the material, while the fresh air is taken in at the outlet for the material and then flows through the device in countercurrent mode. As mentioned above, however, the posed objective is a uniform temperature over the length and width of the heat treatment tunnel. On account of the high feeding velocity; i.e., rate of travel, of the textile material to be heated, a large amount of air is entrained by the material in the inlet slot so that a temperature drop occurs in the zone of the material inlet slot. In order to solve this problem, the additional provision is made, according to the invention, that a fresh air exhaust duct within the heat treatment tunnel is open toward the length of material, extending over the width of and directly following the material inlet slot; this duct runs up to a fan intake connecting pipe. In this way, the fresh are entrained with the material is exhausted in the upward direction immediately downstream of the material feed slot; thus, the entrained air, basically constituting a drawback, is advantageously utilized as fresh air for supplementing the heat treatment medium; i.e., heated air circulation, which is necessary anyway.

According to the invention, a fan intake chamber tapers pointedly in a conical configuration toward the top. It is advantageous for a uniform temperature over the length of the heat treatment tunnel to be able to feed the entrained or fresh air exhausted at the inlet to each fan in a manner distributed over the length of the fan intake chamber. For this purpose, the invention provides that the fan intake chamber is closed at its topside; namely, upstream of the intake duct of the fans, by means of an additional screen cover for the formation of a distributing channel. The fresh air intake duct, at an end face of the distributing channel, is then in communication with the latter. By the arrangement of the additional screen cover, it is thus made possible for all fans arranged over the length of the heat treatment tunnel to take in fresh air; namely, the entrained air at the inlet, in a simple way.

This type of exhausting of entrained fresh air, however, can also be disadvantageous if one has to fear condensation of vaporized finishing agent or the like. Such finishing agent would then be deposited in droplet form on the entering threads, which must be avoided at any cost. In such a case, it is more advantageous to associate the intake connecting pipe of a fan with a controllable fresh air supply; this fan intermingles the fresh air, which may have been taken in while cold, with the warm air and then blows the air through the heating units. In this case, each fan, or every second fan, must be associated with a controllable exhaust air well, thus being able to accurately control the degree of saturation of the waste air to be discharged.

The device of this invention serves very advantageously for the treatment of threads or fibers held horizontally in tensioned condition. Thus, no endless belt or any chain is provided for guiding the fibrillary material through the tunnel; rather, the threads are held merely in tensioned condition between holding means arranged upstream and downstream, such as rollers or like tensioning and guiding units. Since a relatively large number of threads, arranged directly side-by-side, is treated in this hot-air treating tunnel, and these threads can be introduced only in succession to pass through the heat treatment tunnel, while the already introduced threads precede the former threads in their production, a large heat loss and discards of threads or the like would occur if the device were to be opened along its longitudinal side during the start-up operation. It is, therefore, advantageous to provide such a setting tunnel with a narrow feed slot extending over the entire length of the tunnel. It cannot be avoided that the temperature in the tunnel is affected by this feed slot. This disadvantage is diminished according to this invention by arranging the feed slot at a higher level than the guide plane of the tensioned threads. In this way, the cold air, which may have been taken in through the feed slot, does not come into contact with the threads, because such air is exhausted immediately above and away from the threads.

Conducting the air from the bottom toward the top and providing the arrangement for the fans, for the associated intake chamber, and the location of the heating unit below the thread route has the advantage that the air flow carries the threads and thereby longitudinal tension due to the inherent weight of the threads is reduced. This relief provided for the threads may, however, have disadvantageous effects, in some applications, for example, if the threads are not held so tightly tensioned between the holding elements arranged upstream and downstream, and then an indefinite position results for the threads, leading to improper direct contact between adjacent threads. Besides, care must be taken that any thread waste produced, for example, thread remnants occurring during threading, do not come into contact with threads already in production. Such discards accumulate, for example, in case of an air flow direction upwardly on the underside of the upper screen cover, pile up at that location during the course of time to form larger, heavier particles which then, due to their weight, fall downwardly and thus onto the thread route even though the air flow is directed upwardly; this results in impairment of the quality of the threads to be treated.

These problems can be overcome by providing an air flow in the opposite direction. This air flow, now oriented from the top toward the bottom, has the advantage that the threads, tensioned in the longitudinal direction, but being freely suspended while traversing the tunnel, are firmly disposed in the air stream without oscillating or without danger of mutual contact between neighboring threads, or even mutual adherence between threads. In this case, the cleaning problem has thus also been taken care of. Especially when the fans are shut down, the fiber residues retained on the underside of the top screen cover by the air stream will, in this case, not fall downwards thereby contaminating any threads somewhere being manufactured; rather, the fine threads will immediately drop to the ground and/or on the screen plate provided underneath the thread route, from where there contaminants can readily be removed when cleaning the device.

Heat treatment tunnels with an air circulation directed from the top toward the bottom, associated for this purpose with fans on the underside of the length of material are known, for example, from the above-cited belt dryer. However, the important point here is not only this circulation, but the special, uniform access and efflux of air over the working width with an exactly uniform temperature distribution. The features for solving this problem cannot be derived from the heretofore described prior art.

The aforementioned tunnel with cross flow ventilation is especially advantageous. The type of heating employed is very advantageous, inasmuch as the threads conducted through the tunnel are subjected to an all-around flow of a uniformly heated air quantity. Besides, so-called infrared tunnels have been known as well in a general fashion, wherein the radiant heat is produced by electricity. The advantage of these infrared radiators resides in their good controllability and an always ensured uniform heating of the radiators over their length. However, a disadvantage resides in the fact that conditions make it necessary to arrange the radiators at mutual spacings, so that it is impossible to provide over the entire area of the tunnel a uniform heating of the route or length of material.

Therefore, the invention is also based on the objective of providing such a tunnel wherein the energy necessary for heating the threads conducted therethrough is produced by electricity, but an exactly uniformly distributed radiation is attainable over the length and width of the tunnel, especially with low feed rates.

In order to solve this problem, the invention provides a plurality of individual, electrically heated, planar nonferrous cast metal plates in close side-by-side and juxtaposed relationship over the length and width of the heating tunnel. The advantage of these cast metal plates resides in uniform heat emission over their entire radiation areas. A metal-encased tubular heating element extends through the plate for heating purposes, a heating coil being held in this tubular heating element in a highly compressed insulation. During the casting of the cast metal plate, a solid metallic bond is established between the heating element and the material of the plate; the latter consists either of an aluminum alloy or a brass alloy. Due to the high heat conductivity of the alloys used herein, the heat produced by electrical energy in the tubular heating element is uniformly distributed over the entire area of the cast metal plate so that heat transfer to the material to be treated is ensured not only in the zone of the tubular heating element, but over the entire area of the cast metal plate as well. Even if the tunnel must be made up of a plurality, for example 80, of these heating units, heat transmission over the entire area of the tunnel is yet uniform, as long as the arrangement of these units is, in all cases, in close adjacency to one another.

A prerequisite for an always uniform heat radiation is, therefore, the direct juxtaposition of the cast metal plates in the longitudinal and transverse directions of the tunnel. Thus, advantageously, the individual cast metal plates should always be arranged without an air gap, forming a unitary cover, over the entire area of the tunnel. This is possible, however, due to the thermal expansion of the cast metal plates occurring during heating and cooling, only if they are firmly joined together, optionally by means of screws. It is also possible to suspend the cast metal plates, respectively, individually within the housing, in a displaceable fashion for reasons of thermal expansion, or to support the plates in the housing, but this would not ensure the desired radiation density during the course of utilizing the tunnel. In this connection, it should be kept in mind that the individual cast metal plates, though remaining close together during expansion, the dimensional enlargements being added up until the end of the tunnel is reached, would in each case stay at their heated-up location during cooling of the tunnel. Larger or smaller air gaps would be produced, so that when the tunnel is used again, there would no longer be assurance of uniform heat distribution.

If no air gap is to be present between the individual cast metal plates, it is advantageous to arrange such plates flush in series in the longitudinal and transverse directions, and to connect by means of screws, respectively, four cast metal plates at the contacting corners by means of a plate of the same material.

The entire amount of thermal expansion must be considered when constructing this unitary ceiling or floor panel, now consisting of a plurality of firmly joined heating plates. It is advantageous to provide the individual cast metal plates with a groove all round the four edges, at a spacing from the radiation area; a tongue member holding the two, respectively, adjacent cast metal plates engages into this groove. This tongue member should extend over the entire width continuously in the transverse direction of the tunnel, so that, if necessary, individual defective plates can be readily replaced. The tongue members extending in the longitudinal direction of the tunnel must then be interrupted at the level of the transversly arranged tongue members. In order to attach the cast metal plates to the ceiling or floor of the tunnel, it is advantageous to mount, rather than the single cast metal plate, merely the tongue members joining the cast metal plates to the ceiling or in the floor, so that such tongue members are held displaceably in the housing, which latter is heat-insulated by insulation 20' with respect to the cast metal plates and remains in the cold state.

A heat treatment tunnel of the aforedescribed type has the advantage of a slow, uniform heating up of the threads when entering the tunnel, so that a gentle heat treatment for the tensioned threads is imaginable. This is possible, in particular, if the threads are exposed purely to radiation. Unfortunately, however, this is often impossible, alone due to the air entrained with the entering threads. This air layer on the threads or the length of material entering especially at high speed, results in an inhibition of the radiant heating, with an undesired convection, and thus in a nonuniform heating of the length of material over the working width; in this connection, the profile of the entrained air layer is approximately of parabola shape over the working width and thus the energy transmission of the heating plates must be regulated correspondingly. Yet, even with an optimum control means, especially at the inlet of the tunnel, uniform heating of the threads over the working width cannot be attained satisfactorily.

For disturbing the air layer entering with the threads, consideration has been given to the provision of devices for rendering the boundary air layer turbulent, at least in the zone of the inlet, whereby the tunnel, operating merely by radiation, would then be combined with a now intentional, convective heating mode. In the final analysis, such measures with devices terminating in the very close proximity of the threads are inadequate for obtaining an exactly uniform treatment of the threads over the working width. This is true, in particular, because measurement of the, respectively, occurring temperature along the course of the threads is possible only with difficulties. Consequently, a regulation of radiant heat is likewise unsatisfactory.

It is an object of the invention to overcome even this problem, in such a way that the advantages of radiant heating can still be exploited while yet attaining a uniform treatment temperature over the working width without a regulation of the individual radiant heating plates which would be too expensive.

Therefore, the invention provides advantageously that the cast metal plates are held in close adjacency only in the transverse direction, while, in the longitudinal direction of the tunnel, respectively, an air passage gap is kept vacant transversely over the tunnel between these cast metal plates, which latter can also be combined into various groups; this air gap is in communication with an air circulating means. By using a device of this type, a genuine combination is achieved between the very advantageous radiation tunnel and the aforementioned, purely convective heating tunnel. The heat treatment; e.g., heat setting, tunnel with pure cross ventilation, though ensuring a uniform treatment temperature over the working width, can in certain cases be too aggressive, however, with respect to the heating-up speed of the threads, especially in case of sensitive qualities. Additionally, in the cross ventilation tunnel, heating energy is required which must be produced outside of the device—and thus with incurrence of losses. In the tunnel of this construction, the external air entrained with the threads can now be completely eliminated. Such external air has no longer an effect on the temperature distribution within the tunnel, because it is removed, for example, immediately at the inlet and thus is prevented from affecting the heating-up characteristic of the threads. However, since an air layer moving with the threads within the tunnel cannot be avoided, it is expedient to provide such cross ventilation also within the tunnel, especially when the textile material travels at a high velocity through the heat treatment tunnel.

A special advantage of a device of this invention resides in that the heating of the tunnel takes place solely with the aid of radiation. This also holds true with respect to the circulated cross ventilation air which is heated up, for example, by the walls within the tunnel exposed to the radiation, especially a perforated cover in the region of the accumulation chamber provided underneath the threads for rendering the upwardly oriented air flow uniform.

Besides an inlet slot and an outlet slot at the end faces of the above-described tunnel, a feed slot is, furthermore, provided extending over the length of one side of the device through which, respectively, cold air can penetrate into the treatment chamber. The inlet and outlet slots are necessarily open at all times due to the continuously passing material. In contrast thereto, the feed slot can be sealed off. It is possible to seal the feed slot by brushes oriented in the upward and/or downward directions. During startup of the heat treatment tunnel, a laying-in device can be introduced into the tunnel through these brushes and pulled through the tunnel therealong. In this way, one thread after another is introduced into the tunnel by the operator who travels from the upstream tensioning unit to the downstream tensioning unit. This feeding procedure must take place at the velocity of the supplied threads and thus must occur very quickly.

A brush sealing means is often inadequate for a complete sealing of the feed slot, not only during insertion of the threads but also during production. In particular, in case circulated air is produced within the tunnel, cold air is constantly taken in by the circulation-producing fan from the outside through the brush seal, making a uniform temperature distribution over the width of the tunnel impossible in many cases. The consequence is a marked temperature drop in the tunnel in the direction toward the feed slot.

It is, therefore, likewise an object of the invention to find a sealing means for this material feed slot, ensuring during production a complete seal for the air within the tunnel, which sealing means can be opened during the successive insertion of the plurality of threads for a short time, especially only at the level of the laying-in device, but is otherwise closed off, so that even during startup of the tunnel, only a small amount of extraneous air passes into the tunnel and, therefore, no rejects are produced during this startup time.

The solution of this supplemental problem is seen in that the slot is sealed by a wall which, against resistance, yields briefly in the upward or downward direction. Suitably, the wall is subdivided many times over its length and hingedly joined at the separating sites. These measures ensure that, during operation of the tunnel, the wall absolutely seals off the feed slot. However, during laying-in of the threads, a feed device can be pulled without substantial resistance longitudinally through the slot. The wall will be lifted upwardly by force only in the zone of this laying-in device, and immediately thereafter resumes its initial position. The sealing wall thus is similar to a curtain, underneath which the laying-in device can be guided along substantially without impediment.

Even though, with this device according to the invention, a low-loss manufacture of a plurality of closely juxtaposed threads is made possible, the deposition of thread remnants or at least condensed finishing agent cannot be avoided. Cleaning of the tunnel may be required from time to time. However, shutting down production for this purpose should be avoided if at all possible; for this reason, the invention provides the arrangement of an automatically operating cleaning device. This cleaning device can be designed in the form of a wire net which is arranged underneath the thread route and, for cleaning purposes, is pulled through the length of the tunnel while it is simply being unreeled and reeled up. However, it is also possible to mount the screen covers or screen plates to be displaceable and readily exchangeable.

The drawings show several embodiments of the device of this invention. Still further inventive features, which are also of substantial importance in combination with one another, will be explained with reference to these drawings wherein.

Figure 1:
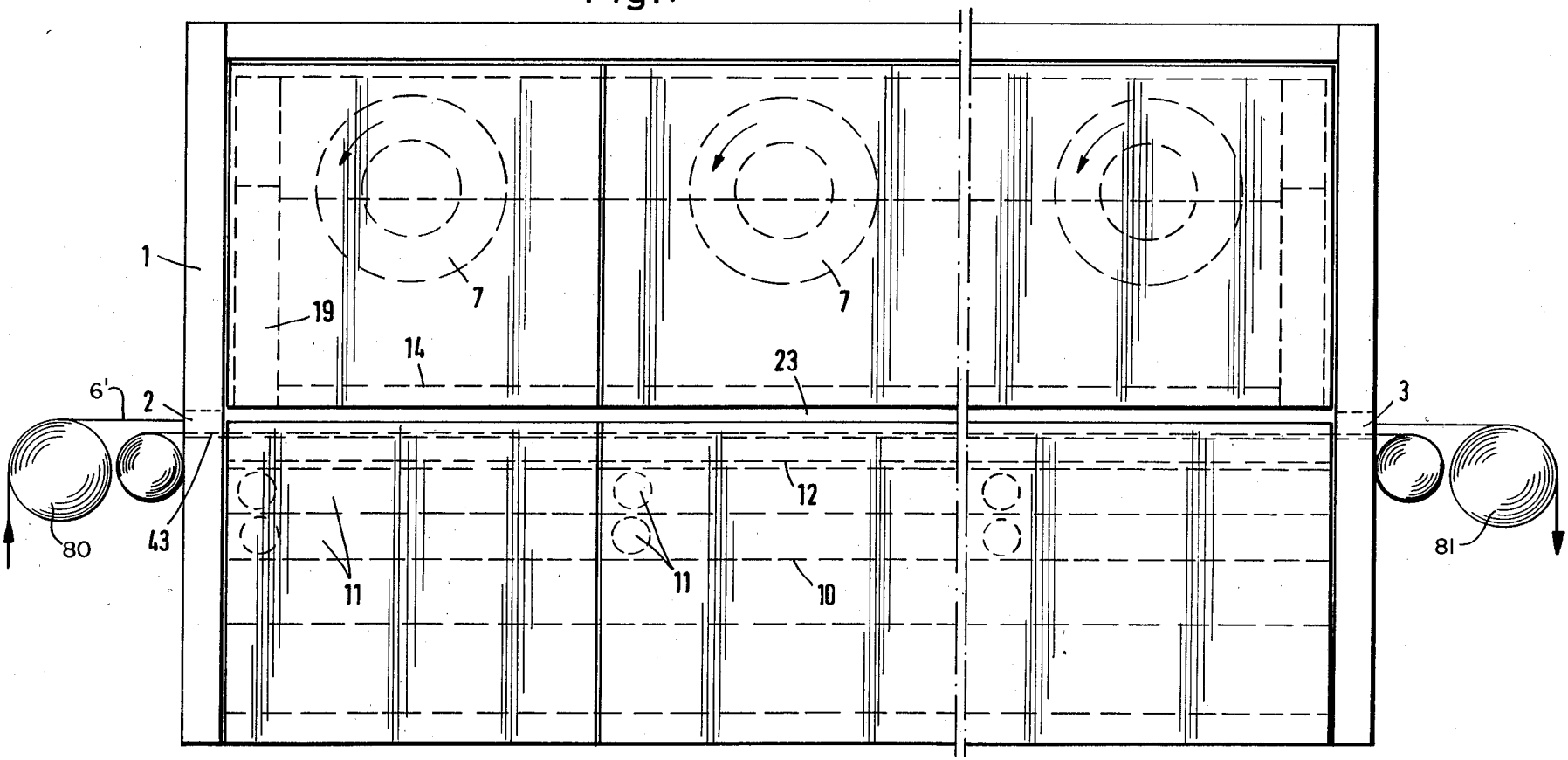
FIG. 1 shows a side view of a cross flow ventilation heat treatment tunnel.

In FIG. 1, the device consists of a housing 1, heat-insulated all around, this housing has a slot at the inlet 2 and a slot at the outlet 3, each of which extend merely across the width of the housing, and a feed slot 23 extending along one side of the length of the device. The space within the housing 1 is subdivided according to FIG. 2 into a fan chamber 4 and into a treatment chamber 5. Above the indicated thread path or route 6 of the fibrillary material here to be treated, the radial-flow fan 7 in the fan chamber 4 is associated with the treatment chamber 5. The air, accelerated by the fan 7, flows downwardly past supply pipes 8 for the heating medium into an accumulation chamber 9 defined in the upward direction; i.e., at the top, by a perforated cover 10 equipped with many small openings and at the bottom by the non-perforated trough 46.

Above the screen cover 10, heating units fashioned as ribbed pipes 11 are arranged over the entire length and width of the treatment chamber of the device, in this case, in two superimposed groups or layers. The marginal zones; i.e., the end portions, of the ribbed pipes 11 are covered so that they are air-impermeable by cover member 21, and are additionally retained in the zone of the insulated side wall of the housing 1 by means of heat insulation 20. At this location, a flow of heating energy; e.g., by radiation and convection, toward the outside must be absolutely prevented. Above the ribbed pipes 11, another screen cover 12 is arranged, completing the air accumulation zone. By these screens providing flow resistances for the entering and exiting air, the heat around the heating units 11 is rendered assuredly uniform. There is not only a uniform flow of heated air over the working width and length of the treatment chamber from the bottom toward the top, but there is also a good temperature distribution due to an appropriate insulation 20 on the outer wall of housing 1.

Additionally, narrower plates 13 provided with slotted openings are mounted above the screen cover 12 defining the heating zone; these additional plates, for cleaning purposes, can be readily inserted from above through the side doors 22 or from the end face and can thus be continuously removed from the device. In a direction further upwardly as seen in the flow direction, the thread route 6 is then—as mentioned above—held between tensioning and guiding units arranged upstream of the inlet slot 2 and downstream of the outlet slot 3; these tensioning units are designated by reference numerals 80 and 81, respectively, in FIG. 1 in the drawings. Above this thread route 6, another screen cover 14 is then provided, followed by the fan intake chamber 15, which narrows conically in the direction of the center of the width of the thread route 6. Above another screen cover 16 defining the upward portion of the fan intake chamber 15, a distributing channel 17 extends over the entire length of the tunnel, followed along the longitudinal side by the fan intake ducts 18 of the fans 7 arranged along the length, as seen in FIG. 1 and, along the end face, by a fresh air exhaust duct 19.

The fresh air exhaust duct 19 is arranged on the inside of the tunnel directly following the feed slot 2, over the width of the feed slot 2. This duct is open toward the length of material traveling the path 6 and terminates, tapering in the upward direction, at the distributing channel 17. Thereby the fans 7 are in communication with the fresh air exhaust duct 19 over the entire length of the tunnel, so that each fan is supplied with fresh air from the inlet.

In order to avoid disadvantageous condensation of vaporized finishing agents or the like on the fresh air exhaust duct and thus dripping of these condensates onto the thread path 6, it is more advantageous to associate with the fan intake duct 18, in any event with the fan intake connection pipe, a fresh air supply pipe 19″ regulated by means of a flap valve or a fan, in such a way that any condensate collecting at that location cannot drip on the thread route 6. An exhaust air pipe 19‴ is to be associated with the fan chamber 4 in such a case, respectively, one supply and exhaust pipe can be provided for a tunnel section with one, two, or more fans 7.

The thread feed slot 23 is arranged above the guide plane for the tensioned threads 6 so that the cold air suctioned off through the slot 23 in the upward direction does not come into contact with the threads 6′. Customarily, the insert slot 23 is sealed by a brush closure. However, other closure means 35 are, in greater detail, hereinafter described with reference to FIGS. 10–14.

Figure 2:
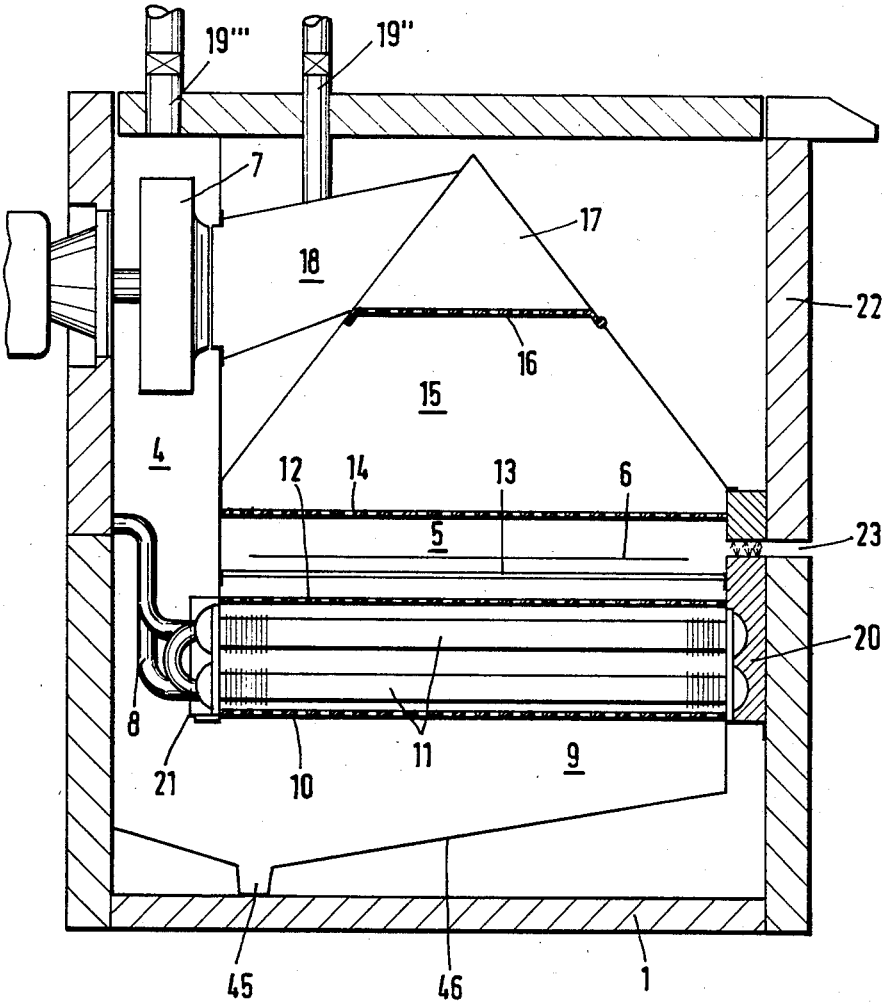
FIG. 2 is a cross-sectional view through the device of FIG. 1.

During the heat treatment of the threads traveling along the path 6, the finishing agent adhering thereto is evaporated; this finishing agent is to be removed, after saturating the treatment air, from the exhaust air pipe 19‴ in the gaseous phase, but will be first condensed, at least partially, on housing walls. This holds true, in particular, regarding the cold fresh air feed pipe 19″, but also for the screen plates 13 directly below the thread path 6. Also fiber remnants are deposited at that location. For cleaning purposes, these screen plates 13 are fashioned to be exchangeable, for example, by pushing clean screen plates 13 at the inlet 2 onto the guide rails 44 shown in FIG. 11 and, simultaneously, removing screen plates to be cleaned at the outlet 3. It is also possible to provide a displaceable wire net 43 to lie on the screen plates 13, as can be seen from FIG. 1, which net is stored in reeled-up condition at the inlet and outlet. Finally, the collecting bottom trough 46 is arranged in the device, as shown in FIG. 2; the impurities converge on the longitudinal channel 45 of this trough and can be removed from time to time by means of a steam jet. For this purpose, this longitudinal channel 45 is connected with an exhaust pipe 19'.

Figure 3:
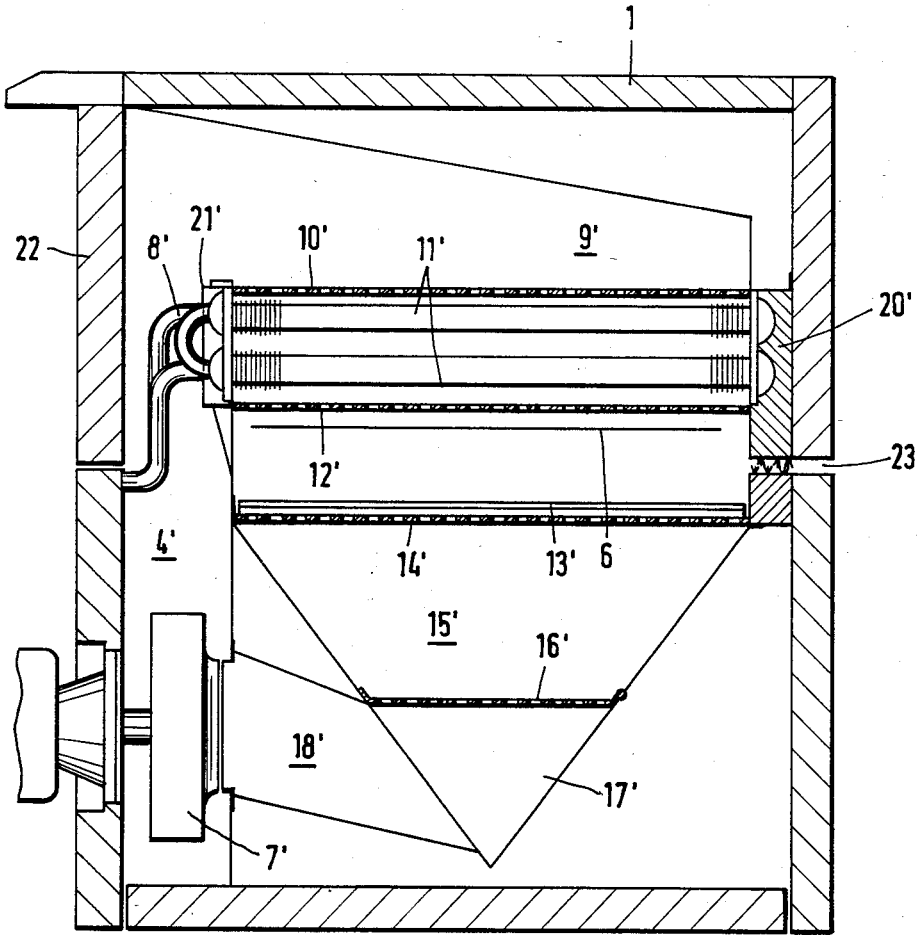
FIG. 3 shows a cross-sectional view of another device similar to that in FIG. 2, but with means for effecting opposite air circulation.

FIG. 3 shows the same device as in FIG. 2, but with the air circulation being reversed. Identical parts bear the same reference numerals, but with the prime ' in FIG. 3. The reasons for this construction have been explained in detail in the introductory description of the invention and need not be repeated here.

Figure 4:
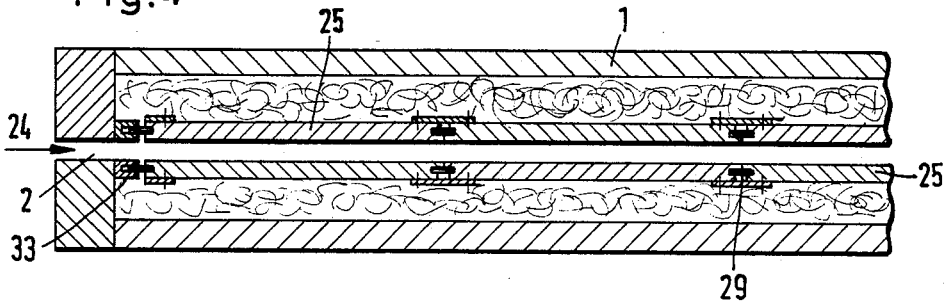
FIG. 4 shows, in an elevational view, a section longitudinally through a radiation heat treatment tunnel.
Figure 5:
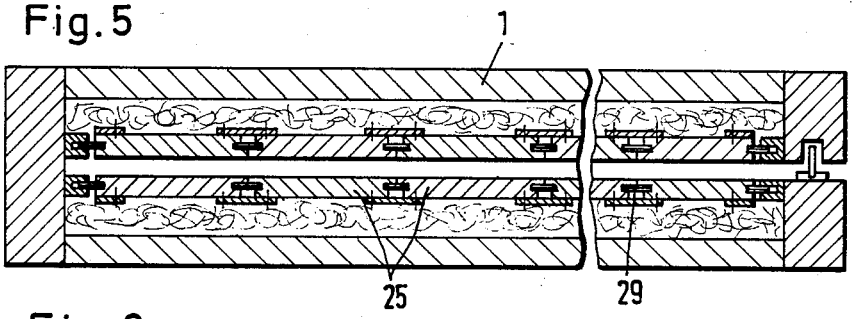
FIG. 5 shows, in an elevational view, a section transversely through the tunnel according to FIG. 4.

Regarding the heat treatment tunnel of FIG. 4, only the zone of material inlet 2 is illustrated in the drawing. A plurality of individually heated, plate-shaped radiation heating elements 25 are arranged in close series and side-by-side relationship above and below the thread path 6 traveling along the material-conducting plane, to be assumed in the drawing to be at the level of arrow 24. The radiant heating elements 25 are cast from a nonferrous alloy and are heated electrically by an integrally cast, individually controllable tubular heating element 26 uniformly over the radiation area 27. At the end faces of the four surrounding edges, the heating elements 25 have a groove 28 at a spacing from the radiation area 27. Respectively, one tongue member 29 is inserted in the groove 28, this tongue member carrying on its other longitudinal side the adjacent heating element 25. The heating elements 25 are thus joined displaceably with each other by such a tongue-and-groove connection on all four edges with respect to the neighboring heating element 25. In this arrangement, there is no gap in the direction of the thread route, so that the radiating surface is continuous. In the direction opposite to the radiating surface 27, the heating elements 25 are cut away according to FIG. 7 above the groove 28 that that—as explained later—mounting of the tongues 29 to the housing 1' of the heat treatment tunnel is made possible.

Figure 6:
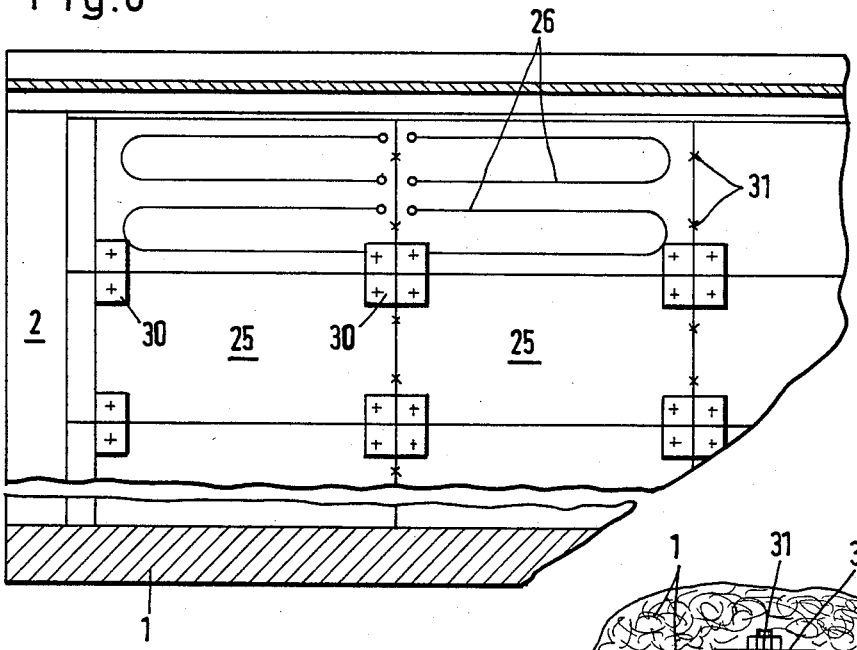
FIG. 6 shows, in a horizontal projection, a section through the tunnel shown in FIG. 4 or 5, at the level of the material-conducting plane.

As can be seen from FIG. 6, the heating elements 25 are disposed in flush sequence in the longitudinal as well as transverse directions. An offset arrangement is impossible, considering the need for a gap-free structure. Respectively, four of the heating elements 25 in contact at one point are threaded together by a coupling fishplate 30 made of the same material. By this firm connection of the heating elements 25, a unitary radiation cover is created from the plurality of heating elements 25, this cover in total being expanded or contracted in its dimensions during heating and cooling, preferably from the center toward the edges and toward the inlet and outlet, respectively. Thus, no air gaps can be produced between the individual heating elements 25, which gaps would be an obstacle in the absolutely uniform radiation over the entire area of the tunnel with no controlled convection.

Figure 7:
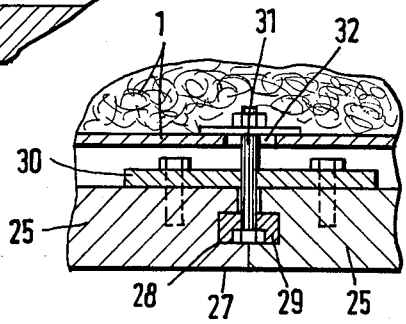
FIG. 7 shows, in an enlarged view, a detail of FIG. 5.

FIG. 7 shows in detail the screw connections and the mounting of the heating elements 25 with an inner wall of the housing 1' carrying the heating elements. The tongue member 29 inserted in the neighboring heating elements has individual holes in case of the tongues extending transversely through the heat treatment tunnel (FIG. 6); screws 31 are pushed through these holes and are threaded to a wall of the housing. The cast metal plates and the connecting fishplate 30 of, respectively, four heating elements 25 are made of the same material so that there is no relative thermal expansion in this arrangement. The wall of the housing, however, is made of a ferrous metal so that shifting of the heating elements 25 with respect to this wall must be provided. For this purpose, slotted holes 32 are arranged in the housing wall 1, through which the screws 31 extend and can thus move as desired with respect to the housing wall 1 during operation. The thermal expansion of the plurality of plate-shaped heating elements will occur approximately diagonally through the heat treatment tunnel. Correspondingly, the slotted holes 32 are to be formed appropriately. The heating elements are, likewise, retained by a tongue-and-groove connection 33 in the zone of the continuously extending housing wall, but in this location the necessary relative shifting is made possible by a correspondingly deep design of the grooves.

Figure 8:
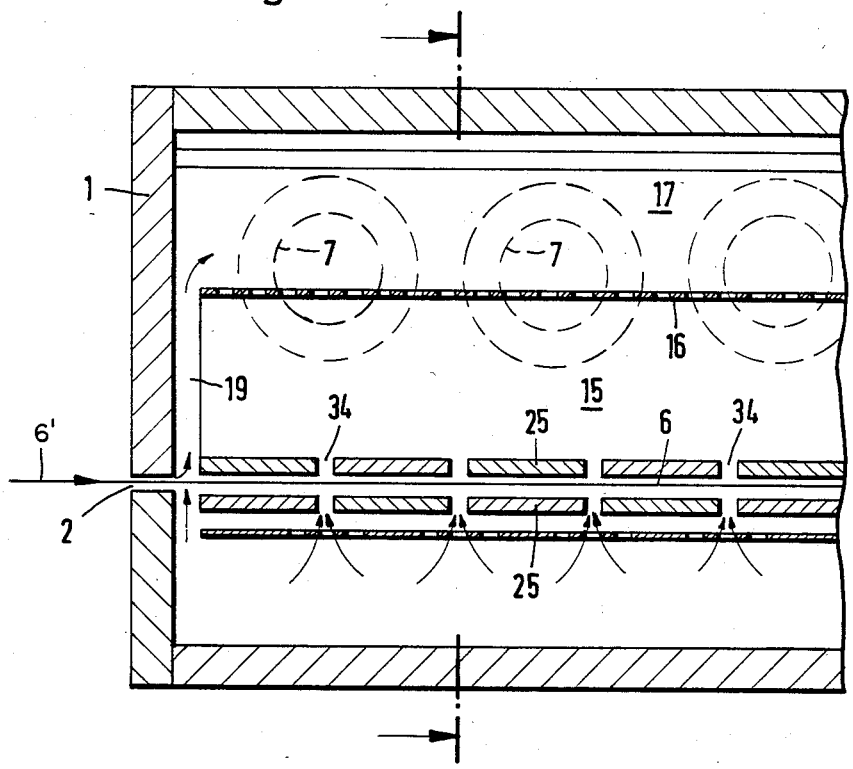
FIG. 8 shows a section longitudinally through a radiation tunnel with cross ventilation auxiliary heating means.
Figure 9:
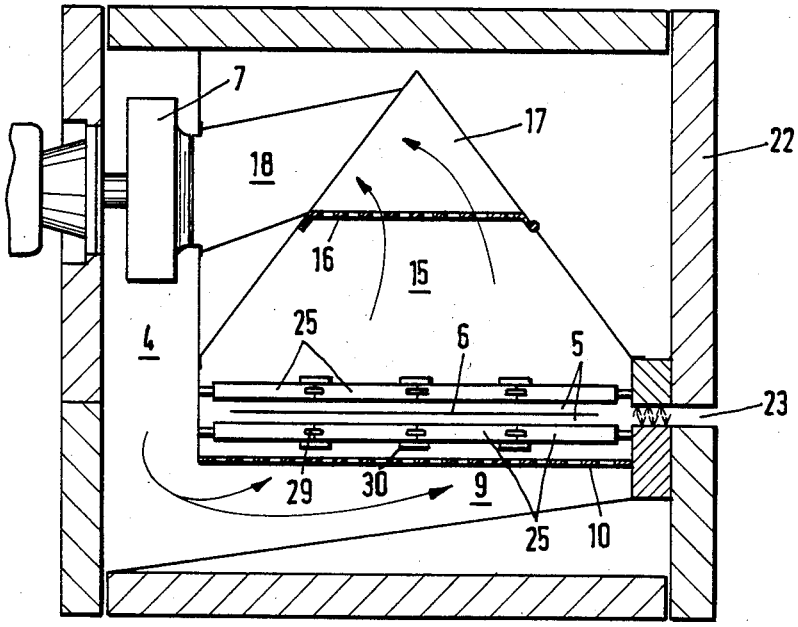
FIG. 9 is a section transversely through the tunnel of FIG. 8 along the dot-dash line IX—IX.
Figure 10:
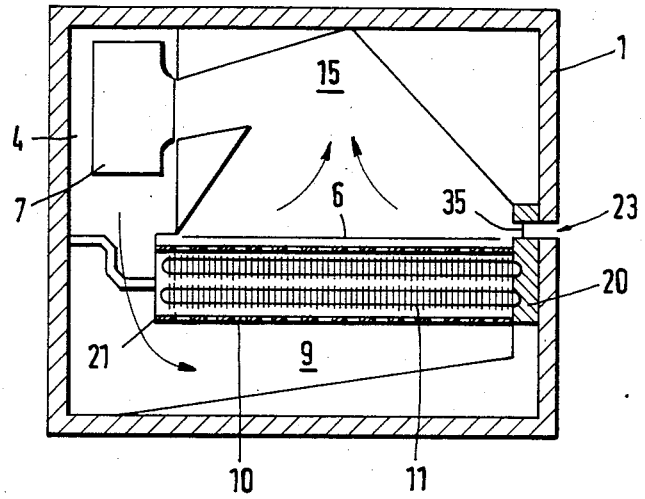
FIG. 10 is a cross section through a cross ventilation setting tunnel with circulating air heating, similar to that shown in FIG. 2.
Figure 11:
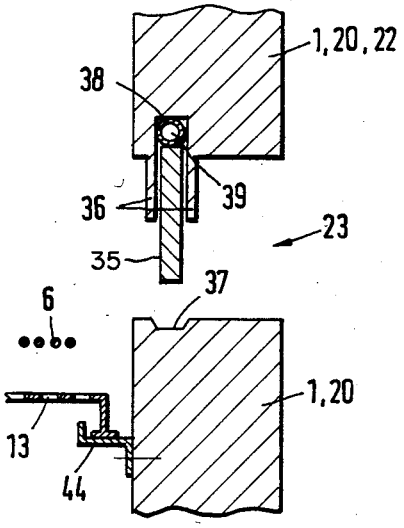
FIG. 11 shows, in an enlarged representation, the feed slot shown in FIG. 10.
Figure 12:
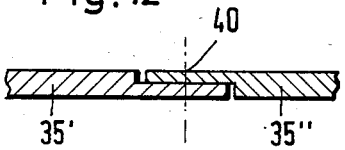
FIG. 12 shows the sealing wall for the feed slot according to FIG. 11 in a top view in the region of a hinge.

In the tunnel construction, according to FIGS. 8 and 9, a plurality of individual, heated radiation elements 25 is, likewise, arranged above and below the thread route or path 6 in close side-by-side relationship across the treatment chamber (see FIG. 9), but at mutual spacings one behind the other (see FIG. 8). The radiant heating elements 25 are cast of a nonferrous alloy, as in case of the tunnel according to FIGS. 4–7, and they are heated electrically by means of an integrally cast, individually controllable heating element uniformly over the radiation surface. In the transverse direction, the radiant heating elements are joined by a tongue-and-groove connection 29 and/or by a threaded connecting fishplate 30. In contrast to FIGS. 4–7, in the longitudinal direction, air passages or gaps 34 are provided across the working width between the individual radiant heating elements 25, which can also consist of groups of such radiant heating elements; heated circulation air flows through these gaps from the bottom toward the top, in accordance with the illustrated arrows to provide further control of the heat treatment.

In order to produce this circulation air, the space within the housing, just as in the tunnel of FIG. 2, is subdivided into a fan chamber 4 and into a treatment chamber 5. Above the indicated thread route 6, a radial-flow fan 7 is associated in the fan chamber 4 with the treatment chamber 5. The air, accelerated by the fan 7, flows downwardly into an accumulation chamber 9 delimited in the upward direction by a perforated screen cover 10. Above the screen cover 10, the radiant heating elements 25 are arranged which also emit radiant energy in the direction of the screen cover 10. Thereby the screen cover 10 is heated up and, consequently, serves for heating the circulating cross ventilation air. At the same time, heat accumulation on the rear side of the radiant heating elements 25 is, in this way, prevented. The screen cover 10 can be perforated over its entire surface, but can also be provided with perforations for air passage only in the zone of the air passages 34. The essential aspect is that in this case laminar air flow prevails in these air passages 34.

The advantage of the illustrated device resides in the combination of a radiant heating effect and a controlled cross ventilation heating effect exerted on the threads. The air entrained with the threads and also the air moving with the threads in the tunnel while adhering to the threads is repeatedly removed by the cross ventilation air passing through the threads and is utilized for a uniform heating of the threads. The number of air passages provided above and below the thread route between the radiant heating elements is arbitrary. The slots can be more numerous at the inlet. At the outlet, merely an air curtain will be of advantage, which is to prevent the exit of the heated air with the threads.

All of the aforedescribed heat treatment tunnels consist of the all-around, heat-insulated housing 1, exhibiting at both end faces, respectively, the horizontally oriented inlet and outlet slots illustrated in FIG. 1. Otherwise, the housing 1 is open only via the feed slot 23 shown also in FIG. 10, which feed slot extends horizontally along one longitudinal side over the length of the tunnel.

The tunnel must be sealed against the intake of foreign air. A feet slot 23, on the other hand, is necessary. The structure of the feed slot shown on an enlarged scale in FIG. 11 ensures sufficient sealing action during the laying-in of the threads as well as during production; i.e., during the heat treatment of the fibrillary material. For this purpose, a wall 35 is mounted to be upwardly displaceable in a vertical guide means 36 over the entire length of the feed slot 23. The wall 35 is guided at the bottom in a groove 37 corresponding to the width of the wall 35 so that during the lowered position of the wall 35 the air is prevented by a kind of labyrinth seal from penetrating into the heat treatment tunnel. On the side opposite to the groove 37, a free space 38 is provided above the guide means 36 for the upward movement of the wall 35 during the laying-in of the threads 6. This free space is filled by an elastically resilient material—in this instance by an elastic hose 39.

The wall 35 is subdivided in multiples—as seen over the length of the feed slot 23. At the respective parting sites, the wall members 35', 35" are hingedly joined. As can be seen from FIG. 12, the wall 35 is of equal thickness over the entire length, and in the region of the joints 40, the members 35', 35" are cut by milling in an L-shape whereby the mutually overlapping flanges of the members 35', 35", arranged in mutual mirror-image symmetry, give external air no opportunity for penetrating into the tunnel, during insertion of the threads 6 as well as during the lowered position of the wall 35. The joints 40 between the members 35', 35" can be produced by a rivet or by undercut portions in the material of the wall 35 proper. It is expedient to fashion the connection similarly to a snap button whereby even in the zone of these joints 40 the heat is prevented from penetrating from the inside toward the outside.

Figure 13:
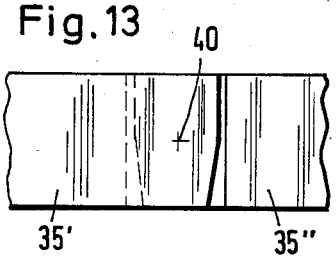
FIG. 13 shows the sealing wall according to FIG. 12 in an elevational view.
Figure 14:
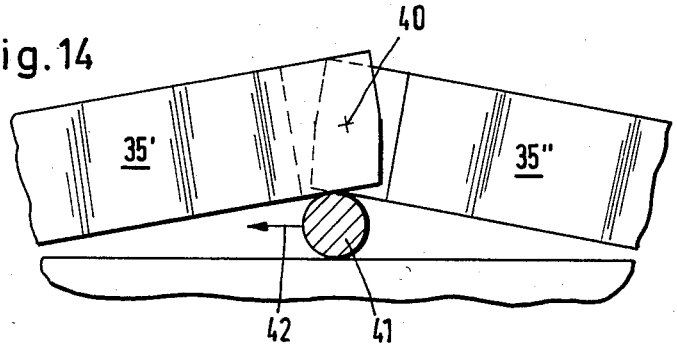
FIG. 14 shows the sealing wall according to FIG. 13 during the operation of pulling a laying-in device therethrough.

FIGS. 13 and 14 show how the curtain wall 35 of this invention operates during the laying-in of the threads. During thread insertion, a laying-in means 41 must be pulled repeatedly at high speed through the feed slot 23. Thereby the member 35', 35" of the wall 35, urged from the downward position upwardly by the laying-in means 41, is in each case moved upwardly against the resistance of the hose 39, whereby the wall 35 will be aligned in the zone of the respective joint 40 similarly as shown in FIG. 14. Immediately following the moving away of the laying-in means 41 in the direction of arrow 42, the wall 35, under the effect of its own weight, and also each individual member 35', 35", under the pressure of the hose 39, will be moved downwardly again and retained in the groove 37. By the forward movement 42 of the laying-in means 41, the wall 35 will thus open up only briefly in the zone of the laying-in means 41 in the manner of a camel's hump. With the forward movement of the laying-in means 41, the hump slinks forward like a snake's coil so that the wall immediately, thereafter, can regain its full sealing function.

What is claimed is:

1. A horizontal heat treatment tunnel for the treatment of fibers, threads, slit film or the like fibrillary material used in the textile field, wherein the material to be heat treated is transported side-by-side along a travel path, in endless length form, through the horizontally arranged tunnel, said tunnel comprising a heat-insulated housing having a treatment chamber, an inlet means for allowing entry of the material and an outlet means for allowing withdrawal of the material from the housing; a fan chamber; fan means arranged within said fan chamber for effecting circulation of a gaseous treatment medium within said housing and through said treatment chamber; heater means disposed downstream of said fan means in the treatment chamber for heating said treatment medium before the treadment medium contacts fibrillary material moving along said travel path through said treatment chamber; fan intake connecting means positioned solely to draw the gaseous treatment medium away from the travel path; fan exhaust means positioned solely to direct the gaseous treatment medium toward the travel path through the fibrillary material and toward the fan intake connecting means; said fan intake connecting means including a fan intake chamber that is narrowed conically away from the travel path on both sides towards the center of the travel path for promoting uniform flow of the treatment medium through the fibrillary material; said heater means extending in parallel with and in close juxtaposition to the travel path over the entire length and width of the travel path; screen wall means arranged above and below said heater means for regulating the flow of treatment medium through said heater means whereby heat is retained around said heater means; means for sealing marginal zones of the heater means so that said zones are gas-impermeable to prevent heat losses from said heater means; and guide means outside of said heat-insulated housing for transporting the fibrillary material along said travel path through the treatment chamber within said housing in a contact-free manner.

2. A heat treatment tunnel according to claim 1, wherein the fan intake connecting means is positioned above the travel path, the fan exhaust means comprises openings positioned below the travel path and the heater means is arranged directly below the travel path.

3. A heat treatment tunnel according to claim 1, wherein the fan intake connecting means is positioned solely below the travel path; the fan exhaust means are positioned solely above the travel path; and the heater means extends in parallel with and directly above the travel path over the entire length and width of the path.

4. A heat treatment tunnel according to claim 1, wherein the heater means comprises ribbed pipes traversed by a fluid heating medium; at least two rows of said ribbed pipes being arranged one below the other and in close proximity side-by-side, in such a way that the ribs of the adjacent ribbed pipes are in contact with one another.

5. A heat treatment tunnel according to claim 1 wherein the air-impermeable sealing means of the heater means is heat-insulated with respect to a heat insulated outer wall of said housing.

6. A heat treatment tunnel according to claim 1 wherein a screen cover means is arranged between the travel path of the material and a fan intake channel associated with the fan intake connecting means.

7. A heat treatment tunnel according to claim 1, wherein said heat insulated housing is provided with a material feed slot arranged along one longitudinal side of said housing extending the entire length thereof, the material being heated being introduced through said heat slot over the length of the tunnel during start-up of the heat treatment within said tunnel and sealing means for preventing entry of atmospheric air into said tunnel via said feed slot.

8. A heat treatment tunnel according to claim 1, wherein the fan intake chamber, as seen in cross-section, tapers in triangular shape acutely in the direction leading toward the fan.

9. A heat treatment tunnel according to claim 6, wherein the fan intake connecting means comprises a pipe associated, via an intake duct with an outlet portion of the fan intake chamber.

10. A heat treatment tunnel according to claim 8, wherein the intake duct, flaring conically from the fan intake connecting pipe, is connected to the fan intake chamber.

11. A heat treatment tunnel according to claim 10, wherein the fan intake chamber is closed, upstream of the intake duct by another screen cover means to form a distributing channel.

12. A heat treatment tunnel according to claim 11, wherein the distributing channel is open over the length of the tunnel.

13. A heat treatment tunnel according to claim 12, further comprising a fresh air supply; and said inlet means comprising a material inlet slot; a fresh air exhaust duct extending over the width of the material inlet slot and directly adjoining the slot, said duct being open toward the travel path and leading to the distributing channel.

14. A heat treatment tunnel according to claim 12, wherein the fresh air exhaust duct extends up to an end face of the distributing duct and is open toward the duct.

15. A heat treatment tunnel according to claim 9, further comprising a fresh air supply; a fresh air feed pipe being associated with the fan means or said intake duct whereby fresh air is drawn into said fan means.

16. A heat treatment tunnel according to claim 15, wherein an opening for the fresh air feed pipe located in an intake duct is arranged above a lower, closed wall of the intake duct.

17. A heat treatment tunnel according to claim 15, wherein said fan means comprises a plurality of fans arranged along the length of the tunnel, said tunnel being subdivided over its length into compartments with respect to the air cycles generated by said plurality of fans, and a fresh air supply pipe and an air exhaust pipe being arranged in each compartment.

18. A horizontal heat treatment tunnel for the treatment of fibers, threads, slit film or like fibrillary material used in the textile field, wherein the fibrillary material is transported along a travel path, in endless length form, in close mutual adjacency through the horizontally positioned tunnel; said tunnel comprising a heat-insulated housing having an inlet means for allowing entry of said material and an outlet means for allowing withdrawal of said material; heating means arranged above and below the traveling length of material; said heating means including a plurality of individually electrically heated, planar nonferrous cast metal plates that are arranged over the width of the travel path in close side-by-side relationship with one another, wherein said cast metal plates are held in contact with one another in the transverse direction, and in the longitudinal direction of the tunnel, an air passage slot being formed transversely across the travel path between each of at least one group of transversely contacting plates; and a gas circulating means for causing the flow of a gaseous treatment medium through the slots arranged above and below the traveling length of fibrillary material whereby the gaseous treatment medium flows transversely through the fibrillary material.

19. A heat treatment tunnel according to claim 18, wherein the gas circulating means comprises a radial-flow fan arranged laterally and above a treatment chamber through which the travel path exends; said fan producing an air flow oriented in the slot from the bottom toward the top.

20. A heat treatment tunnel according to claim 19, wherein the air flow in the slot is of a laminar character.

21. A heat treatment tunnel according to claim 18, wherein an air accumulating chamber is disposed below the length of traveling material, optionally below cast metal plates, which plates are also arranged below said travel path.

22. A heat treatment tunnel according to claim 21, wherein the air accumulating chamber is covered toward the top by an at least partially air-permeable screen cover.

23. A heat treatment tunnel according to claim 22, wherein the screen cover is employed as a circulating-air heating unit.

24. A heat treatment tunnel according to claim 18, wherein said gas circulating means comprises a fan means, and further comprising a fan intake chamber narrowed on both sides conically toward the center of the length of traveling material above the travel path.

25. A heat treatment tunnel according to claim 24, wherein the fan intake chamber, as seen in cross-section, extends upwardly in a pointed taper of triangular form.

26. A heat treatment tunnel according to claim 24, wherein a fan intake connecting pipe is associated, via an intake duct with the upper portion of the fan intake chamber.

27. A heat treatment tunnel according to claim 26, wherein the intake duct, which conically widens starting at the fan intake connecting pipe, is connected to the fan intake chamber.

28. A heat treatment tunnel according to claim 26, wherein the fan intake chamber is closed at its topside upstream of the intake duct by means of an additional screen cover in order to form a distributing channel.

* * * * *